US008942403B2

(12) United States Patent
Oman et al.

(10) Patent No.: US 8,942,403 B2
(45) Date of Patent: Jan. 27, 2015

(54) WIRING HARNESS FOR CLOTHING, ELECTRONIC DEVICES INCLUDING SUCH A WIRING HARNESS, AND GARMENTS INCORPORATING SUCH A WIRING HARNESS AND ELECTRONIC DEVICE

(71) Applicant: Skullcandy, Inc., Park City, UT (US)

(72) Inventors: Courtney C. Oman, Aptos, CA (US); James D. Oman, Aptos, CA (US); Jon Lee Anderson, Salt Lake City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 13/679,666

(22) Filed: Nov. 16, 2012

(65) Prior Publication Data

US 2013/0130540 A1 May 23, 2013

Related U.S. Application Data

(60) Provisional application No. 61/561,677, filed on Nov. 18, 2011.

(51) Int. Cl.
*H04R 9/08* (2006.01)
*A41D 1/00* (2006.01)
(Continued)

(52) U.S. Cl.
CPC ..... *A41D 1/005* (2013.01); *H01B 7/0045* (2013.01); *H01R 31/005* (2013.01); *A41D 2200/20* (2013.01)
USPC ..... 381/364; 439/527

(58) Field of Classification Search
USPC ..... 439/527; 2/69; 381/364
See application file for complete search history.

(56) References Cited

U.S. PATENT DOCUMENTS 5,030,122 A * 7/1991 Birch et al. ..... 439/188
5,563,951 A 10/1996 Wang et al.
(Continued)

FOREIGN PATENT DOCUMENTS

CA 2515558 A1 2/2007
CA 2697029 A1 2/2007
(Continued)

OTHER PUBLICATIONS

Liberty AV Solutions, "Assembly Specification CBL, ASY, AUD, Z200", Aug. 16, 2004, http://www.libertycable.com/products/Liberty-AV-Solutions/Z200MM/Liberty-Z200-Specialty-Audio-Splitter-cable-RCA-male-to-2-RCA-male.*

*Primary Examiner* — Brian Ensey
*Assistant Examiner* — Norman Yu
(74) *Attorney, Agent, or Firm* — TraskBritt

(57) ABSTRACT

A wiring harness for clothing, and garments so equipped. The wiring harness is of asymmetrical configuration, and may extend through channels positioned substantially along reinforced portions of the garment. The wiring harness includes a T-junction from which extend a male media connector and two media cables, a first media cable extending along seams of one side of the garment, and a second media cable extending along a neck portion of the garment from the T-junction at one side to another side, both media cables terminating in male media connectors. The male media connector of the T-junction and the male media connector of the second media cable connect to female media connectors of earphone cables, while the male media connector of the first media cable connects to a female media connector of a portable media device, which may be disposed within a pocket of the garment.

20 Claims, 4 Drawing Sheets

(51) Int. Cl.

| | |
|---|---|
| ***H01B 7/00*** | (2006.01) |
| ***H01R 31/00*** | (2006.01) |
| *H01R 13/60* | (2006.01) |

(56) References Cited

U.S. PATENT DOCUMENTS

| | | | | |
|---|---|---|---|---|
| 6,563,424 | B1 | 5/2003 | Kaario | |
| 6,792,124 | B2 | 9/2004 | Tilbury et al. | |
| 7,187,948 | B2 | 3/2007 | Alden | |
| 7,251,332 | B2 | 7/2007 | Eves | |
| 7,395,090 | B2 | 7/2008 | Alden | |
| 7,519,192 | B1 | 4/2009 | Laycock et al. | |
| D623,627 | S | 9/2010 | Alden | |
| D624,057 | S | 9/2010 | Kelly et al. | |
| D641,003 | S | 7/2011 | Alden | |
| 8,014,824 | B2 | 9/2011 | Alden | |
| D650,356 | S | 12/2011 | Alden et al. | |
| D656,129 | S | 3/2012 | Kelly et al. | |
| D665,776 | S | 8/2012 | Alden et al. | |
| D665,777 | S | 8/2012 | Alden et al. | |
| D673,136 | S | 12/2012 | Kelly et al. | |
| D673,140 | S | 12/2012 | Kelly et al. | |
| D674,372 | S | 1/2013 | Kelly et al. | |
| D674,376 | S | 1/2013 | Kelly et al. | |
| D676,023 | S | 2/2013 | Kelly et al. | |
| D676,024 | S | 2/2013 | Kelly et al. | |
| D677,241 | S | 3/2013 | Kelly et al. | |
| 8,437,481 | B2 * | 5/2013 | Johnson | 381/98 |
| D683,717 | S | 6/2013 | Kelly et al. | |
| D685,759 | S | 7/2013 | Kelly et al. | |
| D685,767 | S | 7/2013 | Kelly et al. | |
| D689,464 | S | 9/2013 | Bonahoom et al. | |
| D691,582 | S | 10/2013 | Nguyen et al. | |
| D693,793 | S | 11/2013 | Kelly et al. | |
| 8,625,835 | B2 * | 1/2014 | Gotlieb | 381/380 |
| D699,216 | S | 2/2014 | Bonahoom et al. | |
| D701,193 | S | 3/2014 | Kelly et al. | |
| D701,196 | S | 3/2014 | Kelly et al. | |
| D701,197 | S | 3/2014 | Kelly et al. | |
| 2004/0154076 | A1 | 8/2004 | Yoo | |
| 2004/0204042 | A1 | 10/2004 | Neaves et al. | |
| 2006/0062413 | A1 | 3/2006 | Wehrell | |
| 2006/0099864 | A1 | 5/2006 | Crumrine et al. | |
| 2007/0142025 | A1 | 6/2007 | Alden | |
| 2007/0245444 | A1 | 10/2007 | Brink | |
| 2008/0267440 | A1 | 10/2008 | Alden | |
| 2011/0019861 | A1 | 1/2011 | Wolfe | |
| 2011/0164776 | A1 | 7/2011 | Kelly et al. | |
| 2011/0235819 | A1 | 9/2011 | Alden | |
| 2012/0128172 | A1 | 5/2012 | Alden | |
| 2012/0275615 | A1 | 11/2012 | Kelly et al. | |
| 2013/0118944 | A1 | 5/2013 | Niiro et al. | |
| 2013/0130540 | A1 | 5/2013 | Oman et al. | |
| 2013/0177165 | A1 | 7/2013 | Oishi | |
| 2013/0177195 | A1 | 7/2013 | Sze et al. | |
| 2013/0185905 | A1 | 7/2013 | Stiff et al. | |
| 2013/0208909 | A1 | 8/2013 | Mülder et al. | |
| 2013/0336514 | A1 | 12/2013 | Kelly et al. | |
| 2014/0056459 | A1 | 2/2014 | Oishi et al. | |

FOREIGN PATENT DOCUMENTS

| | | |
|---|---|---|
| EP | 1760896 | 9/2010 |
| EP | 2262117 | 12/2010 |
| WO | 2012024656 | 2/2010 |
| WO | 2010068495 | 6/2010 |
| WO | 2010124190 | 10/2010 |
| WO | 2011085096 | 7/2011 |

* cited by examiner

WIRING HARNESS FOR CLOTHING, ELECTRONIC DEVICES INCLUDING SUCH A WIRING HARNESS, AND GARMENTS INCORPORATING SUCH A WIRING HARNESS AND ELECTRONIC DEVICE

CROSS-REFERENCE TO RELATED APPLICATION

This application claims the benefit of U.S. provisional patent application Ser. No. 61/561,677, filed Nov. 18, 2011.

FIELD

Embodiments of the present disclosure relate to wiring harnesses suitable for incorporation into clothing, and garments incorporating such wiring harnesses. More particularly, embodiments of the present disclosure relate to wiring harnesses having a first portion that may be affixed to a garment and one or more second portions which are removable from the garment.

BACKGROUND

The advent and widespread adoption of small, solid-state, portable devices for storage and play of media, such as music, books and video, has been startlingly fast and widespread. MP3 players, as exemplified by the IPOD® devices, as well as so-called smart phones which include a media storage capability, as exemplified by the IPHONE® devices, have made portable media a convenience, if not perceived as a necessity, of a large population segment in developed and developing countries.

Such devices, which may be characterized herein generally as "portable media devices," are very light and compact, and are often used in conjunction with wired headphones (which may also be characterized as earphones), which may take the form of on-ear or over-ear headphones, or in-ear headphones, commonly termed "earbuds," for users to access audio media while walking, jogging, cycling or other everyday activities that require movement from a fixed position. As a result, when an individual carries a portable media device, it may prove difficult to easily and comfortably extend the earphone wiring from the location of the portable media player to the user's ears, particular in cooler or cold weather when jackets, sweaters, sweatshirts, waterproof shells, parkas, coats and other outerwear is required. While it is possible to incorporate a wiring harness into a garment to provide a connection between a portable media play and headphones, many outerwear garments require washing from time to time. However, a complete wiring harness including headphones is not susceptible to washing without damage to the headphones. Waterproof headphones are available; however, such products are more expensive than non-waterproof headphones, and the sound quality of these products is generally inferior.

BRIEF SUMMARY

One embodiment of the present disclosure comprises a wiring harness for attachment to a garment, the wiring harness comprising a junction having a male connector, a first media cable extending from a male connector to the junction and a second media cable extending from a male connector to the junction and operably coupled to the male connector of the first media cable and to the male connector of the junction.

Another embodiment comprises a garment including a wiring harness, the garment comprising a body having armholes at opposing sides thereof, and a neckline. A wiring harness is secured to the body, the wiring harness comprising a junction having a male connector, a first media cable extending from a male connector to the junction, and a second media cable extending from a male connector to the junction and operably coupled to the male connector of the media cable and to the male connector of the junction. The junction is disposed proximate the neckline of the garment, the media cable extends along the neckline of the garment, and the male connector thereof and the male connector of the junction are substantially equidistant from a centerline of the garment, and the second media cable extends downwardly from the junction.

DETAILED DESCRIPTION

The illustrations presented herein are not meant to be actual views of any particular wiring harness, earphones or garment, but are merely idealized representations that are employed to describe embodiments of the present disclosure. Throughout this specification, like reference numbers refer to like elements.

As used herein, the terms "headphone," "earphone" and "earbud" mean and include a sound delivery element to be placed over, on, in, or in direct proximity to a user's ear.

As used herein the term "media" means and includes, without limitation, audio media stored in machine-readable form, including, without limitation, music and audio books. Headphones, earphones and earbuds may be characterized herein as media output elements.

Figure 1A:
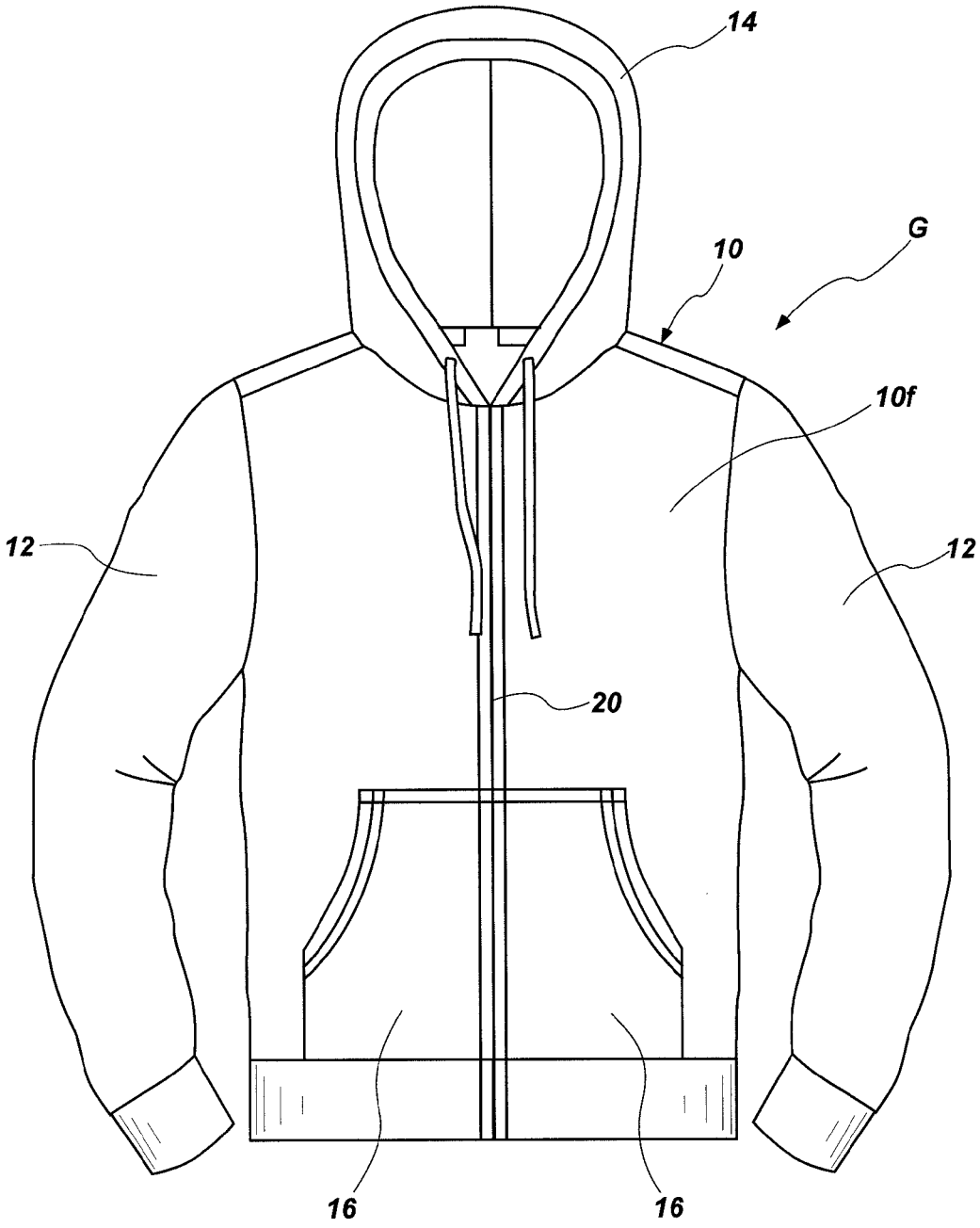
FIGS. 1A and 1B depict a garment incorporating a wiring harness according to one or more embodiments of the disclosure.
Figure 1B:
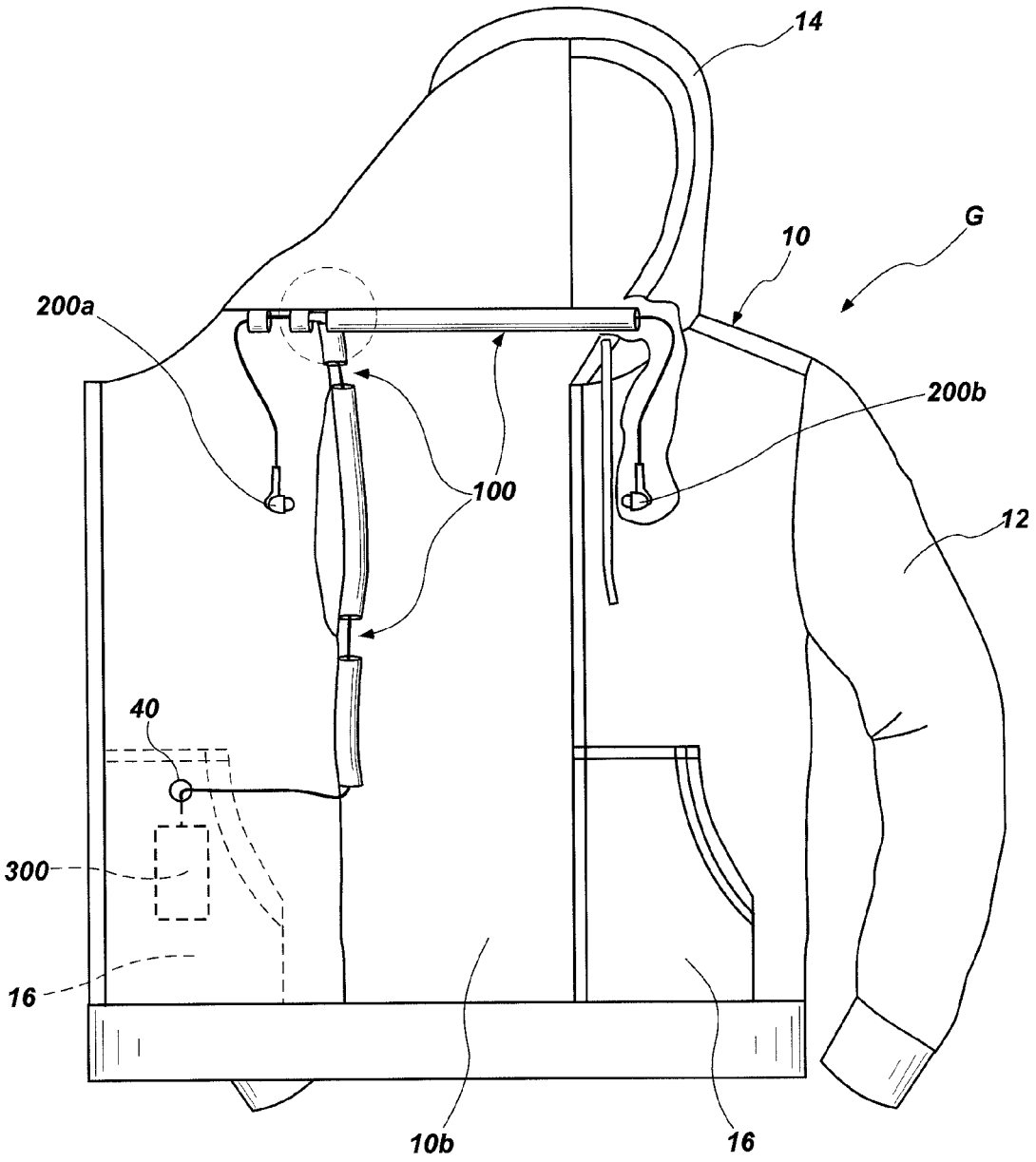

Referring now to FIGS. 1A and 1B of the drawings, a garment G comprising a body 10 including front portion 10*f* (FIG. 1A) and back portion 10*b* (FIG. 1B), and having sleeves 12, a hood 14 and one or more pockets 16 is depicted. FIG. 1A shows garment G with the front portion 10*f* thereof in a closed mode, such as when worn by a user and closed using a closure device 20 such as a zipper, hook-and-loop fabric, snaps, buttons, hooks, etc. FIG. 1B shows garment G in an open mode, depicting the back portion 10*b* and the left-hand side of the garment G (sleeve 12 omitted for clarity) to reveal a wiring harness 100 with headphones in the form of earbuds 200*a*, 200*b* operably coupled to the wiring harness 100. A portable media device 300 is shown in FIG. 1B in broken lines in pocket 16 of garment G, the pocket 16 being hidden from view in FIG. 1B. The term "pocket" as used herein is to be interpreted broadly, and not limited to a pocket in which a hand of the wearer of garment G may be placed, but rather to encompass a receptacle in or on garment G in which a portable media device 300 may be received.

Figure 2:
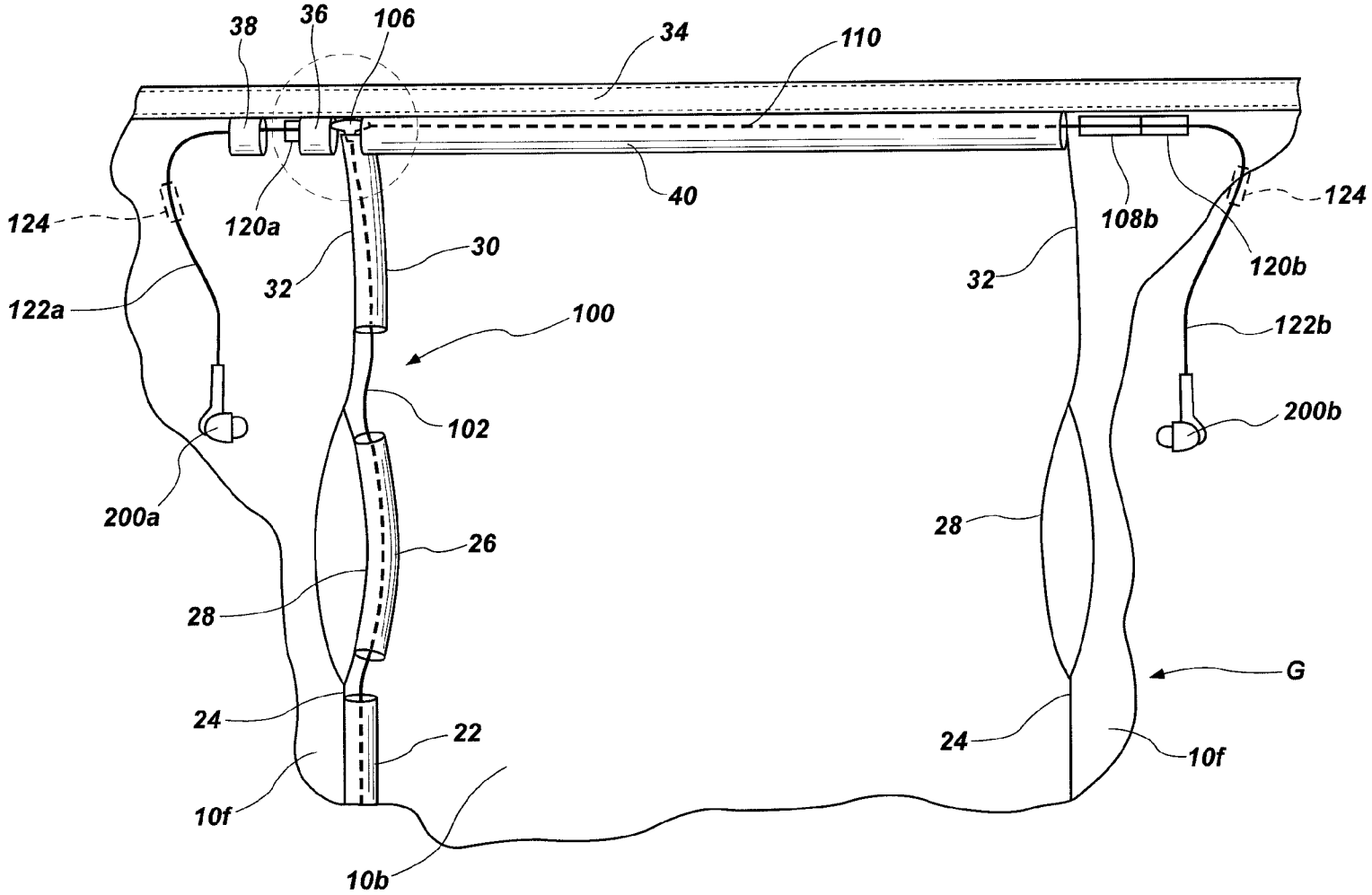
FIG. 2 is an enlarged elevation view of an interior portion of the garment of FIGS. 1A and 1B, showing a wiring harness according to an embodiment of the disclosure secured to the garment.
Figure 3:
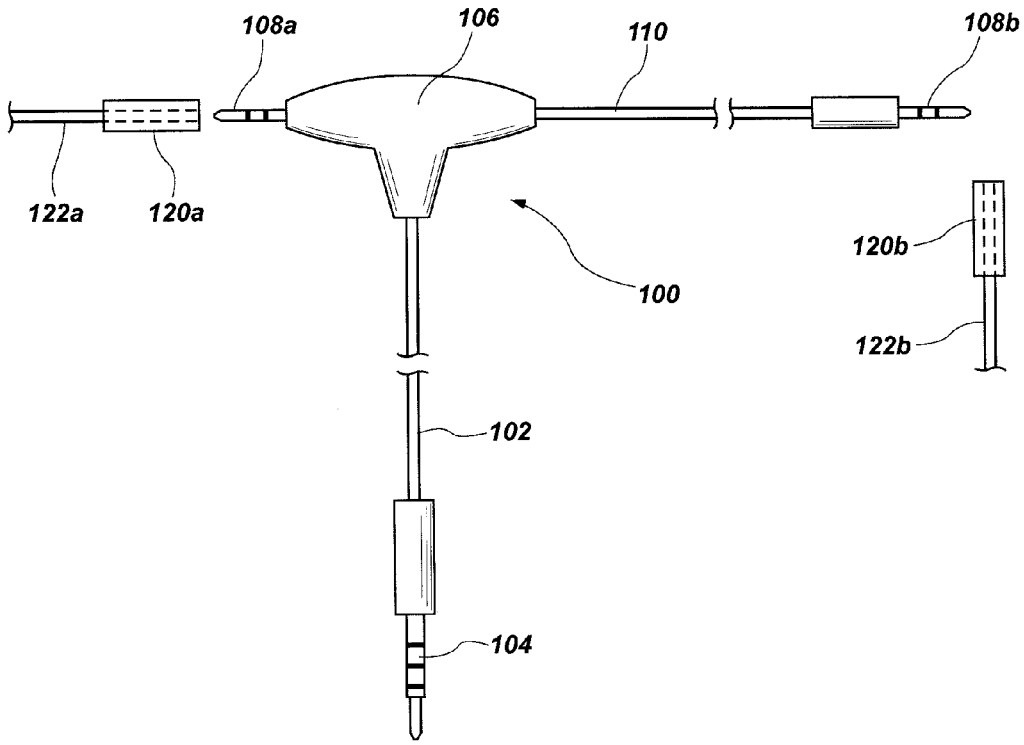
FIG. 3 is an enlarged elevation of a wiring harness according to an embodiment of the disclosure.

FIG. 2 is an enlarged elevation view of the wiring harness 100 and earbuds 200*a*, 200*b* secured within the garment G, and FIG. 3 is an enlarged elevation view of wiring harness 100 separate from the garment G. As shown in FIGS. 1B and 2, the wiring harness 100 has an asymmetric configuration, and comprises a media input cable 102 that terminates at one end in a male media input connector 104, which may be removably disposed in, for example, a pocket 16 for connection to the portable media device 300 when the wiring harness 100 is secured within the garment G. An opposing end of the media input cable 102 terminates at a T-junction 106 (located within the encircled area in FIGS. 1B and 2). As shown in FIG. 3, a male media output connector 108*a* extends from one side of the head of the T-junction 106 and a media output cable 110 extends from an opposing side of the head of the T-junction 106. The media output cable 110 terminates in a male media output connector 108*b*. The media input cable 102 is operably coupled to the male media output connector 108*a* and to the media output cable 110 at the T-junction 106. The wiring harness 100 is asymmetric in that the male media output connector 108*a* is integrally formed with the body of the T-junction 106, whereas the male media output connector 108*b* on an opposing side of the T-junction 106 is not integrally formed with the body of the T-junction 106, but rather connected to the body of the T-junction 106 by the media output cable 110. In this configuration, the male media output connector 108*b* may be positioned a further distance from the T-junction 106 than the male media output connector 108*b*, which is integral to the body of the T-junction 106.

Returning to FIG. 2, the wiring harness 100 may be secured to the garment G via a series of channels, which may also be characterized as wiring guides, which are integrally sewn or otherwise incorporated into the garment G. In one embodiment, the channels may comprise fabric material exhibiting enhanced elasticity, including, for example, and without limitation, fabrics incorporating polyurethane-polyurea fibers generically termed variously as "spandex" and "elastane" and sold under the brand names LYCRA®, ELASPAN®, CREORA®, ROICA®, ACEPORA®, DORLASTAN®, LINEL®, ESPA and others. Spandex fibers exhibit unusual elasticity in comparison to conventional textile fibers, and exhibit both greater tear resistance and durability, and a tension capacity two to three times greater, at one-third of the weight of rubber. Spandex fibers may be stretched under applied tension from three to seven times their initial, unstressed length and revert to the initial length when the applied tension is released. Moreover, spandex fibers are relatively insensitive to transpiration, cosmetics, sun cream and salt water. Spandex fibers provide a greater or lesser desired degree of elasticity to fabrics in which they are incorporated, depending largely upon the knit or weave of the fabric and the amount of spandex fibers employed. The spandex-enhanced fabric is folded over and sewn or otherwise incorporated into or attached to a seam of the garment G to form the channel. In one embodiment, the fabric may have a width of about one-half inch (½") when oriented flat against the garment G to accommodate the cable segments of the wiring harness 100. Specifically, the media input cable 102 extends from the media input connector 104 through a third channel 22 attached to a side seam 24 of garment G, through a second channel 26 attached to a rear arm seam 28, and through a first channel 30 attached to a shoulder seam 32, and terminates at the T-junction 106 adjacent back neck tape 34 extending laterally and proximate a neckline of garment G. Two other, short channels 36 and 38, which may also be characterized as loops in the embodiment of FIG. 2, may be disposed adjacent the T-junction 106. The short channels 36, 38 may be sewn into or otherwise attached to a lower seam of back neck tape 34 at a location disposed outward of a shoulder seam 32. A further upper channel 40, sewn to the lower seam of back neck tape 34, extends substantially across the back of the neck of garment G between opposing shoulder seams 32 and terminates at shoulder seams 32. The media output cable 110 extends through upper channel 40 and terminates at the male media output connector 108*b* disposed proximate the shoulder seam 32 opposite the shoulder seam proximate which T-junction 106 is located. While the upper channel 40 is shown as extending continuously between shoulder seam 32 across the width of the garment G, it should be understood that the upper channel is not limited to a continuous element, and instead may be comprised of multiple channels or the like provided that the media output cable 110 is sufficiently restrained against the garment G to prevent unwanted migration of the output cable 110 while the garment G is being worn by a user.

Forming channels of a fabric exhibiting a high degree of elasticity, such as a spandex-enhanced fabric, not only provides flexibility to the channels to accommodate movement by the garment wearer, but also provides a gripping effect to retain the wiring harness 100 and specifically the media cables thereof, in a relatively fixed position within garment G during such movement. Thus, the positional relationships of media connectors 104, 108*a* and 108*b* within garment G may be maintained without constraining movement of the garment wearer.

In use, the media output connector 108*a* operably couples to a first media output assembly proximate the first shoulder seam 32. The first media output assembly comprises a media input cable 122*a* that terminates in a female media input connector 120*a* at one end and in an earbud 200*a* at the opposite end. The media output connector 108*b* operably couples to a second media output assembly proximate the opposite shoulder seam 32. The second media output assembly comprises a media input cable 122*b* that terminates in a female media input connector 120*b* at one end and in an earbud 200*b* at the opposite end. The connection between the media output connector 108*a* and the media input connector 120*a*, and the adjacent portion of the media input cable 122*a* are supported and protected by the short channels 36 and 38. The media input connector 104 connects to a female output connector (not shown) of a portable media device 300. The media input cable 102 may extend through a metal or plastic grommet or other reinforced aperture 40 (FIG. 1B) in the garment G to the location of media device 300 in a pocket 16.

It will be appreciated by those of ordinary skill in the art that embodiments of the present disclosure offer numerous advantages over the state of the art. By way of example and without limitation, a garment according to embodiments of the disclosure enables washing of the garment after simply disconnecting earbuds 200*a* and 200*b* from male connectors 108*a* and 108*b* of wiring harness 100, and disconnecting the connector 104 from a portable media device 300. The use of all male connectors 104, 108*a* and 108*b* avoids collection of water in and/or on the connectors 104, 108*a* and 108*b* after immersion in water for washing, as might occur in receptacles of female type connectors. Further, the elasticity of the channels facilitates removal and replacement of wiring harness 100 should a component thereof become worn or damaged.

In addition, the use of channels of spandex-enhanced fabric lends elasticity to the channels through which the wiring harness cables extend, facilitating ease of movement by the garment wearer. Further, the positioning of the channels along side, arm, and shoulder seams of the garment and along the underside of back neck tape provides support for the wiring harness cables along structurally reinforced areas of the garment and, in combination with elasticity of the spandex-enhanced fabric, isolates the wiring harness cables from stress on the garment. Placement of the channels along the seams and the neck tape also minimizes discomfort to the wearer of the garment by minimizing binding of the cables.

It will also be appreciated that the use of a T-junction 106 adjacent the back neck seam at the intersection thereof with shoulder seam 32 reduces interference of the T-junction 106 with movement of the wearer and, again, places the T-junction 106 at a reinforced location of the garment to, in combination with the three adjacent channels, isolate it from stress. Further, the use of the T-junction 106 of an embodiment of the disclosure located adjacent one shoulder seam 32 and a back neck tape of the garment G, with one integral media output connector 108*a* and a media output cable 110 leading to a non-integral media output connector 108*b* at an opposing shoulder seam 32, enables use of media output assemblies that include earbuds 200*a*, 200*b* and respective media input cables 122*a*, 122*b* of substantially the same length, providing interchangeability as well as avoiding the inconvenience and discomfort of two earbud cables joined in a "Y" configuration exhibited by many earbud assembly designs. The design of the wiring harness 100 allows the media input cables 122*a* and 122*b* of substantially similar length, and their associated earbuds 200*a* and 200*b*, to extend from the garment G from a location in close proximity to the neck of the garment wearer, in an area below the ears of the wearer, while allowing the media input cable 102 to simultaneously extend along the garment G at a location remote from a centerline of the garment G, such as along the side seam 24, the rear arm seam 28, and the shoulder seam 32 to the T-junction 106. This is particularly advantageous in embodiments where one or more of the media input cables 122*a* and 122*b* comprise an in-line microphone 124 (FIG. 2) to enable voice input for command operation of the media device 300 and/or verbal communications in the case that the media device 300 is also a telecommunications device, e.g., a "smart phone." In such an embodiment, one or both of media input cables 122*a* and 122*b* may be configured with conductors to provide both output (from microphone 124) and input capability (to associated earbud 200*a* or 200*b*), and media input cable 102 may also be configured with conductors to transmit both input from portable media device 300 to media input cables 122*a*, 122*b* and output from microphone 124 to portable media device 300. In this embodiment, because the media input cables 122*a* and 122*b* are disposed symmetrically relative to the user's head, the in-line microphone 124 may be placed at the appropriate position relative to the user's mouth to pick up the user's voice. Further, in the case where only one of the media input cables 122*a* or 122*b* contains a microphone 124, the user can selectively attach the media input cable including the microphone on either side according to his/her preference while maintaining the correct microphone position relative to the user's mouth because the media input cables 122*a* and 122*b* are substantially the same length.

While embodiments of the present disclosure have been described and illustrated with respect to a hooded garment, often termed a "hoodie," the disclosure is not so limited. Garments with and without hoods or sleeves, including but not limited to anoraks, jackets, parkas, shells, coats, vests, knit tops such as, by way of non-limiting example, tee shirts, polo shirts, athletic jerseys, tank tops, and one-piece ski, and snowmobiling suits, as well as other garments configured and incorporating a wiring harness according to an embodiment of the disclosure are contemplated.

The embodiments of the disclosure described above do not limit the scope of the invention, since these embodiments are merely examples of embodiments of the invention, which is defined by the scope of the appended claims and their legal equivalents. Any equivalent embodiments are encompassed within the scope of this invention. Indeed, various modifications of the disclosed embodiments, such as alternate useful combinations of the described elements of the embodiments, will be readily apparent to those skilled in the art from the description. Such modifications also fall within the scope of the appended claims, including legal equivalents.

What is claimed is:

1. A wiring harness for attachment to a garment, the wiring harness comprising:

a junction having a male connector;

a first media cable extending from a male connector to the junction; and a second media cable extending from a male connector to the junction and operably coupled to the male connector of the first media cable and to the male connector of the junction;

wherein the junction comprises a T-junction, the male connector thereof and the first media cable extend from opposing sides of a head of the T, and the second media cable extends from a body of the T-junction.

2. The wiring harness of claim 1, wherein the male connector of the junction is an output, the male connector of the first media cable is an output, and the male connector of the second media cable is an input.

3. The wiring harness of claim 2, further comprising two media output assemblies, each media output assembly comprising:

a female connector operably coupled to a media output element through a cable;

wherein the female connector of each media output assembly is operably coupled to one of the male connector of the junction and the male connector of the first media cable.

4. The wiring harness of claim 3, wherein the two media output assemblies are of substantially equal length.

5. The wiring harness of claim 1, wherein at least one of the male connector of the junction and the first media cable including the male connector thereof comprises both an input and an output, and the second media cable including the male connector thereof comprises both an input and an output.

6. The wiring harness of claim 5, further comprising two media output assemblies, each media output assembly comprising:

a female connector operably coupled to a media output element through a cable, wherein the female connector of each media output assembly and its associated cable is operably coupled to one of the male connector of the junction and the male connector of the media cable;

wherein the cable of at least one media output assembly further comprises an input and a microphone operably coupled to the female connector of the respective media output assembly through the input.

7. The wiring harness of claim 1, further comprising:

a portable media device;

wherein the male connector of the second media cable is operably coupled with the portable media device.

8. A garment including a wiring harness, comprising:

a body having armholes at opposing sides thereof, and a neckline; and a wiring harness secured to the body, the wiring harness comprising:

a junction having a male connector;

a first media cable extending from a male connector to the junction; and a second media cable extending from a male connector to the junction and operably coupled to the male connector of the first media cable and to the male connector of the junction;

wherein the junction is disposed proximate the neckline, the first media cable extends along the neckline of the garment and the male connector thereof and the male connector of the junction are substantially equidistant from a centerline of the garment, and the second media cable extends downwardly from the junction.

9. The garment of claim 8, wherein the body comprises:

a front portion and a rear portion joined along side seams, gaps in the side seams providing the armholes;

a neck tape extending substantially along the neckline;

an upper channel secured along a lower edge of the neck tape, the first media cable extending through the upper channel; and a plurality of side channels, including first and third side channels secured to the side seam at one side of the body above and below the armhole, and a second side channel secured to an armhole seam at a rear of the armhole at the one side of the body, the second media cable extending through the first, second and third side channels.

10. The garment of claim 9, further comprising at least one additional channel secured to the neck tape opposite the upper channel, wherein the junction is secured to the garment between the at least one other channel, the upper channel, and the first side channel.

11. The garment of claim 10, wherein the channels each comprise a spandex-enhanced fabric.

12. The wiring harness of claim 8, wherein the male connector of the junction is an output, the male connector of the first media cable is an output, and the male connector of the second media cable is an input.

13. The wiring harness of claim 12, further comprising two media output assemblies, each media output assembly comprising a female connector operably coupled to a media output element through a cable; wherein the female connector of each media output assembly is operably coupled to one of the male connector of the junction and the male connector of the media cable.

14. The wiring harness of claim 11, wherein the two media output assemblies are of substantially equal length.

15. The wiring harness of claim 6, wherein the junction comprises a T-junction, the male connector thereof and the media cable extending from opposing sides of the T-junction, the another media cable extending from the T-junction.

16. The garment of claim 8, wherein the second media cable extends to a pocket of the garment through an aperture in the body.

17. The garment of claim 14, further comprising a portable media device disposed in the pocket of the garment and structurally and electrically coupled to the second media cable.

18. The garment of claim 8, wherein at least one of the male connector of the junction and the first media cable including the male connector thereof comprises both an input and an output, and the second media cable including the male connector thereof comprises both an input and an output.

19. The garment of claim 18, further comprising two media output assemblies, each media output assembly comprising:

a female connector operably coupled to a media output element through a cable, wherein the female connector of each media output assembly and its associated cable comprises an output and is operably coupled to one of the male connector of the junction and the male connector of the media cable;

wherein the cable of at least one media output assembly with its associated female connector further comprises an input and a microphone operably coupled to the female connector of the respective media output assembly through the input.

20. The garment of claim 8, further comprising:

a portable media device;

wherein the male connector of the second media cable is operably coupled with the portable media device.

* * * * *

UNITED STATES PATENT AND TRADEMARK OFFICE

CERTIFICATE OF CORRECTION

PATENT NO. : 8,942,403 B2
APPLICATION NO. : 13/679666
DATED : January 27, 2015
INVENTOR(S) : Courtney C. Oman, James D. Oman and Jon Lee Anderson It is certified that error appears in the above-identified patent and that said Letters Patent is hereby corrected as shown below:

In the claims:

CLAIM 14, COLUMN 8, LINE 1, change "claim 11," to --claim 13,--

Signed and Sealed this
Twenty-second Day of September, 2015

Michelle K. Lee

Michelle K. Lee
*Director of the United States Patent and Trademark Office*